US011561567B2

(12) United States Patent
Brunk

(10) Patent No.: US 11,561,567 B2
(45) Date of Patent: Jan. 24, 2023

(54) PUSH BUTTON

(71) Applicant: Penn Engineering & Manufacturing Corp., Danboro, PA (US)

(72) Inventor: Jonathan Brunk, Philadelphia, PA (US)

(73) Assignee: Penn Engineering & Manufacturing Corp., Danboro, PA (US)

( * ) Notice: Subject to any disclaimer, the term of this patent is extended or adjusted under 35 U.S.C. 154(b) by 0 days.

(21) Appl. No.: 17/701,228

(22) Filed: Mar. 22, 2022

(65) Prior Publication Data

US 2022/0300027 A1 Sep. 22, 2022

Related U.S. Application Data

(60) Provisional application No. 63/164,140, filed on Mar. 22, 2021.

(51) Int. Cl.

| | |
|---|---|
| ***G05G 1/02*** | (2006.01) |
| ***G05G 7/08*** | (2006.01) |
| ***G05G 5/05*** | (2006.01) |
| ***G05G 5/06*** | (2006.01) |
| ***G05G 5/04*** | (2006.01) |

(52) U.S. Cl.

CPC ..... *G05G 7/08* (2013.01); *G05G 1/02* (2013.01); *G05G 5/04* (2013.01); *G05G 5/05* (2013.01); *G05G 5/06* (2013.01); *G05G 2505/00* (2013.01); *G05G 2700/18* (2013.01)

(58) Field of Classification Search

CPC ..... B43K 24/16; B43K 24/163; B43K 24/08; B43K 24/084; B43K 24/086; B43K 24/146; B43K 24/14; B43K 24/12; B43K 24/06; B43K 24/04; G05G 1/02; G05G 1/025; G05G 5/05; G05G 5/06; G05G 7/02; G05G 7/06; G05G 7/08

See application file for complete search history.

(56) References Cited

U.S. PATENT DOCUMENTS

| | | | | | |
|---|---|---|---|---|---|
| 3,318,289 | A | * | 5/1967 | Marynissen | B43K 24/084 401/110 |
| 3,700,340 | A | * | 10/1972 | Terasaki | B43K 24/16 401/110 |
| 3,703,043 | A | * | 11/1972 | Ogata | D06F 75/18 38/77.83 |
| 4,976,561 | A | * | 12/1990 | Kageyama | B43K 27/003 401/74 |

(Continued)

*Primary Examiner* — Brian J McGovern

(74) *Attorney, Agent, or Firm* — Gregory J. Gore, Esq.

(57) ABSTRACT

The components of a push button comprise a plunger, a retainer, a spring and an end cap. The plunger has a button at the top, a middle section with an enlarged square cross-section, and a pin of reduced diameter at the bottom end. The plunger slidably strokes up and down within a retainer which has an upper portion that closely holds the button on the top of the plunger and also includes a rectilinear recess sized to receive the square midsection of the plunger. A middle portion of the retainer comprises an enlarged cylindrical cavity bounded above and below by opposing roof and floor surfaces. The roof and the floor have cams that engage the corners of the plunger midsection which cause it to rotate during plunger strokes. A spring within the retainer biases the plunger upward. The assembly of parts is captivated by a retainer end cap.

20 Claims, 6 Drawing Sheets

(56) References Cited

U.S. PATENT DOCUMENTS

| | | | | |
|---|---|---|---|---|
| 5,641,060 | A * | 6/1997 | Tracey | H01H 13/58 200/523 |
| 5,913,629 | A * | 6/1999 | Hazzard | B43K 24/08 401/109 |
| 6,257,787 | B1 * | 7/2001 | Kirk | B43K 23/12 401/111 |
| 2003/0202836 | A1 * | 10/2003 | Tong | B43K 23/122 401/107 |
| 2003/0210945 | A1 * | 11/2003 | Noguchi | B43K 29/003 401/111 |
| 2005/0081331 | A1 * | 4/2005 | Forsythe | G05G 1/02 16/110.1 |
| 2006/0103148 | A1 * | 5/2006 | Rechberg | A47B 88/463 292/304 |
| 2009/0169285 | A1 * | 7/2009 | Cabatan | B43K 23/00 401/109 |
| 2015/0084933 | A1 * | 3/2015 | Kinoshita | G06F 3/03545 345/179 |
| 2015/0231916 | A1 * | 8/2015 | Tani | B43K 11/00 29/890.1 |
| 2018/0333980 | A1 * | 11/2018 | Namiki | B43K 24/084 |
| 2020/0218371 | A1 * | 7/2020 | Ushiku | B43K 5/005 |
| 2021/0286398 | A1 * | 9/2021 | Brunk | G05G 5/05 |

* cited by examiner

PUSH BUTTON

RELATED APPLICATIONS

This is a non-provisional patent application related to provisional patent application Ser. No. 63/164,140 entitled, "Push Button" filed on Mar. 22, 2021 priority from which is hereby claimed.

FIELD OF THE INVENTION

The present invention relates to manually operated push buttons employed as mechanical actuators. More specifically it relates to push buttons which employ alternating actuation mechanisms by which a central plunger moves between stable extended and retracted positions.

BACKGROUND OF THE INVENTION

Push buttons with alternating actuation mechanisms which provide central plunger movement between extended and retracted positions have been employed in various applications including writing instruments, door latching hardware, switch actuation, and hydraulic valve actuation, among others. In some cases, primarily in the field of pen writing instruments, the plunger alternatingly moves been stable extended and retracted positions as the plunger is pushed repeatedly in the same direction. This is often called, "alternating actuation".

However, a problem exists in this field because these devices have complicated or delicate mechanisms which are expensive to manufacture or are insufficiently robust for high-force industrial applications. There is therefore a need for a simplified alternate actuation push button mechanism for rugged operating environments which is inexpensive to manufacture and durable.

SUMMARY OF THE INVENTION

In order to meet the need in the art described above the applicant has devised an alternating actuation push button with great industrial applicability. The push button of the invention consists of a minimum number of component parts each of which is of robust construction. In one embodiment, the components only consist of a plunger, a retainer, a spring and an end cap. The plunger has three sections: at the top is a button with a flat end that allows the user to depress and operate the device. A middle section has an enlarged square cross-section and at the bottom is a pin of reduced diameter. When actuated, the pin can engage related structures as a particular application may require.

The plunger slidably strokes up and down within a retainer which has three main portions. An upper portion closely holds the button on the top of the plunger and also includes a rectilinear recess that can receive the square midsection of the plunger. A middle portion of the retainer comprises an enlarged cavity that provides the side clearance for the plunger's enlarged square midsection to rotate. The cavity is cylindrical and bounded above and below by opposing roof and floor surfaces, respectively. The roof and the floor have camming structures that engage the corners of the plunger midsection that cause it to rotate. A spring within the retainer biases the plunger upward. An end cap affixed to the bottom of the retainer captivates the plunger and spring assembly and closely holds the plunger pin. A shank of the end cap which extends from the bottom end of the retainer provides attachment means to affix the push button assembly to an object such as supporting structure.

More specifically, the applicant has devised a push button device comprising a retainer with opposing top and bottom ends having: A collar of reduced diameter is at the top most end of the retainer and axial bore with a square cross-section extends downwardly from the collar. The recess opens into a central cavity of enlarged diameter. The cavity has two opposite facing sets of cams on floor and roof portions thereof respectively, defining the top and bottom of the cavity. A coaxial plunger is slidably operative within the retainer bore moveable between extended and retracted stable positions. The plunger comprises a cylindrical button which extends upwardly from the top end of the retainer through the collar. A cylindrical pin at the distal bottom end of the plunger extends from the bottom end of the retainer when the plunger is in the extended position. An enlarged midsection of the plunger is of lateral square cross-section and sized so that the cams act upon corners of the plunger midsection to turn the plunger in the same rotational direction for each up and down reciprocal stroke of the plunger.

The midsection of the plunger is closely received in the square recess section in the top portion of the retainer when in the retracted position to allow retraction of the plunger. The retainer has an end cap at the bottom end which is affixed to a body of the retainer to captivate the plunger within the retainer. A spring is operative between the end cap and the plunger midsection which urges the plunger upward toward the retracted position. The plunger midsection abuts the retainer collar to stop its upward advancement defining its retracted position. The end cap is received in a retainer counterbore of the retainer. The end cap has a shank extending from the bottom of the retainer which has external attachment means for affixing the retainer to a supporting structure.

Each cam in the retainer cavity has a sharply angled face which is engageable with the corners of the plunger midsection. Each set of cams consists of a circular array of cams positioned along the peripheral wall of the retainer central cavity. The opposing sets of cams are angularly offset from one another one-half the arc length of each cam. Each set of cams preferably consist of sharply pointed vertically extending teeth.

In a second embodiment a separate cam ring insert is utilized for providing the lower set of cams on the floor of the central cavity. The operation of both embodiments is essentially the same with the plunger assuming the extended and retracted positions within the retainer as in the previous embodiment. The cam ring insert is positioned within the retainer and secured by the end cap. The same configuration of the plunger is employed in both embodiments.

In this alternate embodiment the internal configuration of the retainer is different to accept the admission of the cam ring insert during assembly. To this end, the retainer bore has an enlarged counterbore at the bottom to allow introduction of the insert. The counterbore has keyways that engage the cam ring to ensure proper radial orientation of the ring. The insert ring has top and bottom cam sets which are symmetrical about its midplane so that it can be more easily assembled with either face leading.

From the following drawings and description of one embodiment of the invention it will be apparent to those of skill in the art that the objectives of the push button invention to meet the need in the art for a robust and durable push button have been achieved.

DESCRIPTION OF THE PREFERRED EMBODIMENT

The following description relating to the figures of drawing use like numerals for the same elements shown in different figures for ease of cross reference without the need for individual mention to each element enumerated in a specific figure. The embodiments depicted are rotationally symmetrical about a central axis within a circular body but bodies with non-circular outer surfaces are possible.

Figure 1:
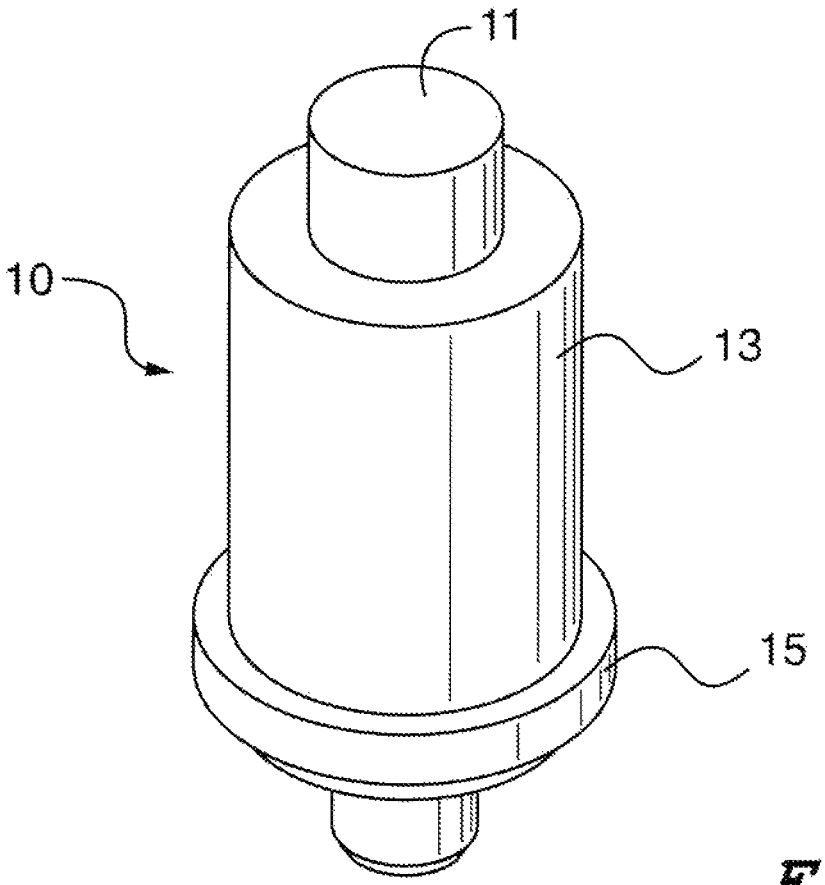
FIG. 1 is a top front perspective view.
Figure 8:
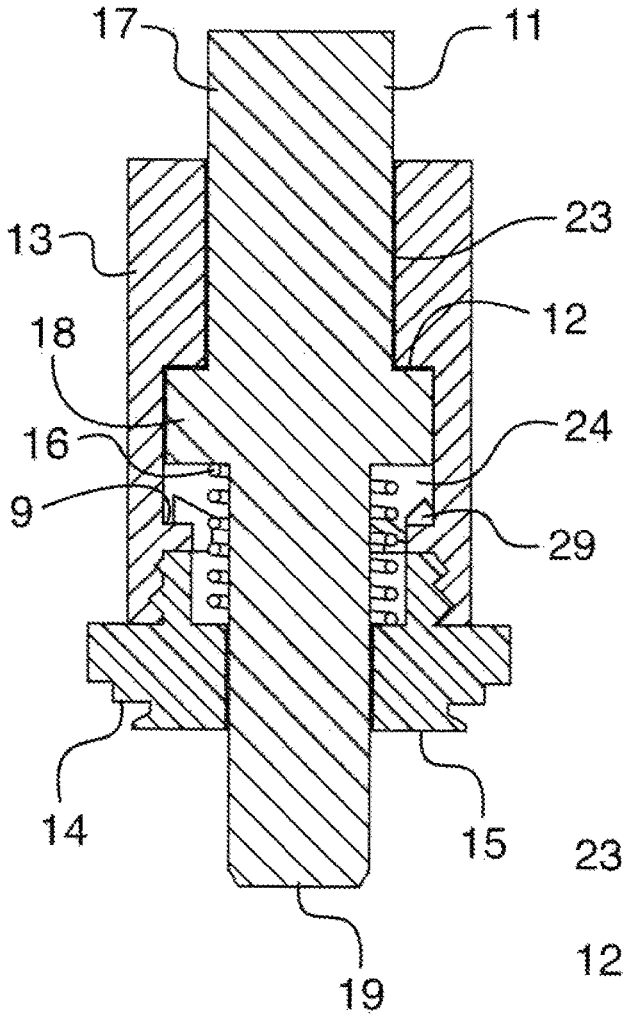
FIG. 8 is a front elevation sectional view showing the extended position.
Figure 9:
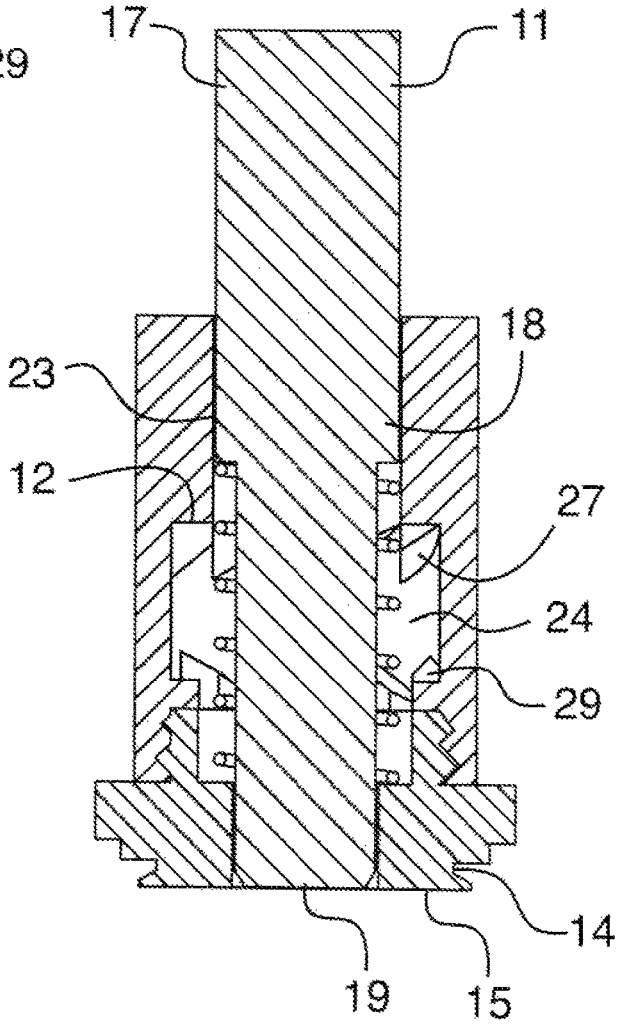
FIG. 9 is a front elevation sectional view showing the retracted position.

Referring now to FIG. 1, one embodiment of the invention is depicted. The push button 10 of the invention is shown which comprises a generally cylindrical retainer 13, a coaxial plunger 11, and an end cap 15. An internal spring as seen in FIGS. 8 and 9 completes the assembly. One advantage of the invention is its simplicity of design requiring only these four components.

Figure 2:
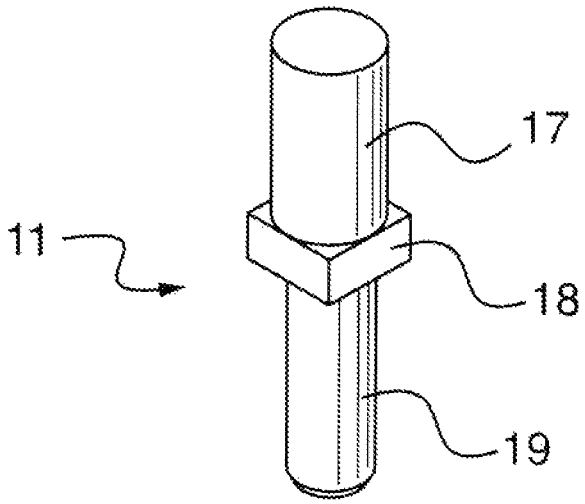
FIG. 2 is a top left perspective view.

Referring to FIG. 2, the push button plunger 11 is seen in isolation. The plunger can be described as comprising three parts: a cylindrical top button 17, an enlarged square midsection 18, and a pin section 19 at the bottom that is the working end of the plunger.

FIGS. 3 through 7 show the details of the retainer 13 seen in FIGS. 1 and 2. It is shown in isolation with in top, bottom and elevation sectional views.

Figure 3:
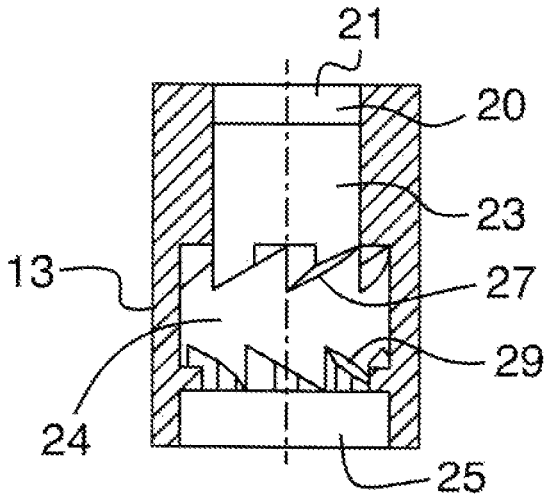
FIG. 3 is a front sectional elevation view.
Figure 4:
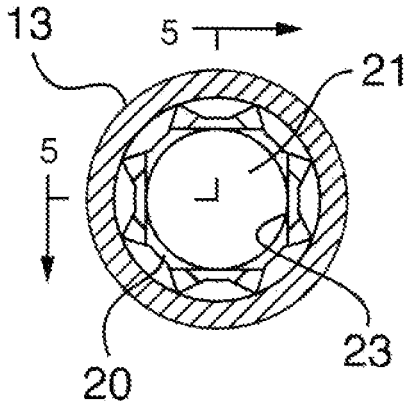
FIG. 4 is a bottom plan view.
Figure 5:
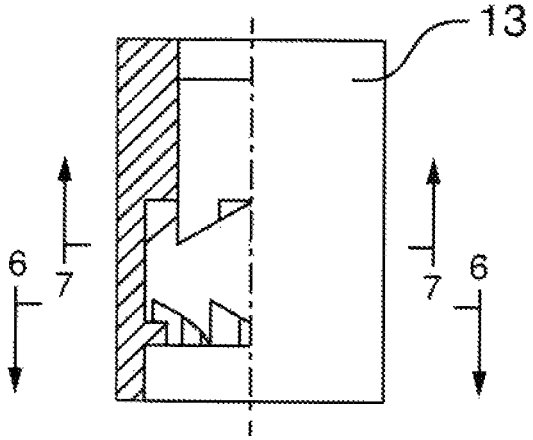
FIG. 5 is a front elevation partial sectional view taken from FIG. 4 as indicated.

Referring now to FIGS. 3, 4, and 5, the top and bottom sets of internal cams and other details of the retainer are be more clearly depicted. Referring to FIG. 3, the main features of the retainer are the retaining collar 20 at the top which terminates the square cross-section recess 23 in an upper portion of the retainer. The retainer in this embodiment is symmetrical about the push button axis A-A. The recess 23 is elongate and of square cross-section. It terminates upwardly to a collar 20 having a circular opening 21 of reduced diameter at the top most end of the retainer 13. Proceeding downward from its top end, the recess 23 progresses downwardly into an enlarged cylindrical central cavity 24 in a middle portion of the retainer. Two opposite facing sets of cams 27 and 29 are arranged along peripheral circular paths on the roof and floor of the cavity 24, respectively. A counterbore 25 at the bottom of the retainer receives the end cap 15 as seen in FIGS. 8 and 9.

The cams are each configured as pointed teeth and the cam sets are angularly offset from each other about the retainer axis one half the arc length of each cam equating to 22.5 angular degrees. In that way the cams act upon the plunger midsection to turn or twist it. Each rotation of the plunger aligns the plunger with the contacted cams, then being angularly offset from the opposing set of cams. The next stroke of the plunger will then add an additional 22.5 degrees of rotation when the opposing cams are contacted only by the corners of the plunger midsection. This occurs for each alternating reciprocal stroke of the plunger. The combined up and down strokes of each press/release cycle causes 45 degrees of angular rotation of the plunger.

Figure 6:
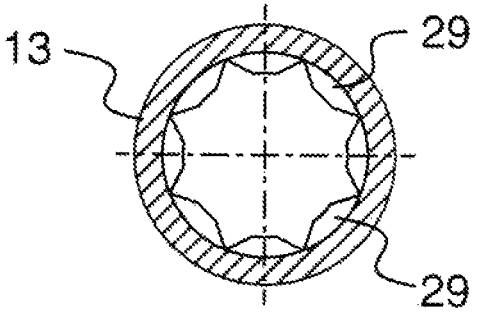
FIG. 6 is a top plan sectional view taken from FIG. 5 as indicated.
Figure 7:
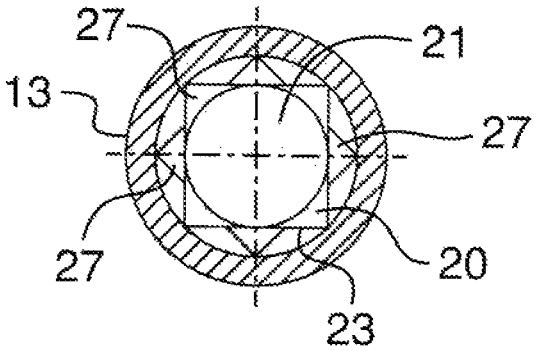
FIG. 7 is a bottom plan sectional view taken from FIG. 5 as indicated.

FIGS. 6 and 7 show the layout of the central cavity floor and roof sets of cams viewed from above and below as indicated by the sectional views as marked on FIG. 5, FIG. 5 in turn being a sectioned view taken from FIG. 4. The upper roof cam set 27 contains four cams and the lower floor set 29 contains eight cams. The floor set consists of a 360-degree circular array of equally spaced cams. In operation, each cam has a sharply angled face that engages one of the corners of the plunger midsection. In FIG. 7 the recess opening 23 in the upper portion of the retainer 13 is configured to closely receive the plunger midsection and extends upwardly from the cavity roof. It is depicted here to show its relation to the cavity roof cams 27. The location of each cam lies within the boundaries of the major and minor diameters of the plunger midsection so that only the edges of the plunger midsection corners contact the cams. The individual cams in each set are substantially identical and angled sharply to form a pointed peak. The sets of cams are oriented to apply a turning force to the plunger in the same rotational direction in both vertical directions of each reciprocal stroke of the plunger so that their rotary positional advancements are additive.

FIGS. 8 and 9 depict the extended and retracted stable states of the push button of the invention. Referring now to FIG. 8, an elevation cross-section view shows the internal features of the completed push button assembly. The assembly is unified by the end cap 15 which has three main features: a recess that receives the bottom of the spring 16; external attachment features that permit the broaching of the end cap into the bottom of the retainer; and attachment means 14 on a shank at the distal end of the end cap. Clinch features are shown which permit the push button assembly to attach to a hole in a receiving panel (not shown).

As seen in FIGS. 3 through 7, the retainer central cavity 24 has camming structures on the cavity floor 9 and on the cavity roof 12 which impart a twisting force or torque to the plunger 11 as it is forced against the cam sets 27 and 29 when the button is depressed and released. As seen in FIGS. 6 and 7 the cam sets are pointed in opposite facing vertical directions around the periphery of the retainer cylindrical central cavity 24. The cams are positioned far enough from the axis of the plunger so that they only engage the corners of the plunger midsection 18.

In FIG. 8, we see the plunger shown in its extended position. The plunger 11 achieves this position by first manually or mechanically pushed downward until the corners of its square midsection 18 are pressed against the cams 29 on the central cavity floor. When the button is released the plunger is then moved upward by the force of the spring 16 until it contacts the cams on the cavity roof which rotates the pin 11 an additional amount. The plunger midsection 18 is now out of alignment with retainer upper square cross section recess and it stops in abutment with the central cavity roof 12 between the cams. The plunger 11 is thus held in this extended position with the end pin 19 of the plunger 11 extending from the bottom of the retainer end cap 15.

Positional stability of the plunger is maintained by the force of the spring 16 acting against the bottom of the plunger midsection 18.

Referring now to FIG. 9, in this figure the plunger is seen in its retracted position. This position is achieved from the extended position shown in FIG. 8 by another similar push and release of the plunger button 17 which again rotates the plunger 45 angular degrees. Here, after another application of 45 degrees of rotation to the plunger, the plunger midsection 18 is now in alignment with the retainer square recess 23. Thus, when the button is released the plunger midsection is received upwardly into the recessed bore by the force of spring 16. This retracts the pin end 19 of the plunger 11 into the end cap 15. The plunger motion is upwardly stopped by the collar seen in FIG. 3 as element 20. The collar 20 has a narrowed circular opening that receives the plunger button as it extends farther from the top of the retainer when the plunger 11 is fully retracted. The plunger 11 is held in this stable retracted position by the force of the spring 16 which operates between the endcap 15 and the bottom of the plunger midsection 18.

By these mechanical relations the present push button operates as follows. As the plunger is successively pushed and released, the action of the cams in both opposite axial directions each apply a rotational force or twist to the plunger in the same rotational direction. Each twist applied to the plunger define 22.5 degrees of rotation so that as the plunger is returned upwardly after the push/release cycle the plunger has rotated a total of 45 degrees. Now, the enlarged square midsection of the plunger is out of alignment with the top recess of the retainer so that the corners of the plunger midsection abut the roof of the central cavity preventing the farther upward retraction of the plunger. This establishes the stable extended position of the push button assembly. When the plunger is depressed and released again, the floor and roof cams acting alternately together apply at total of 45 degrees of rotation to the plunger so that it now aligns with the recess in the top of the retainer. In this position, the force of the internal spring moves the plunger up into the upper recess of the retainer to a stable retracted state.

Figure 10:
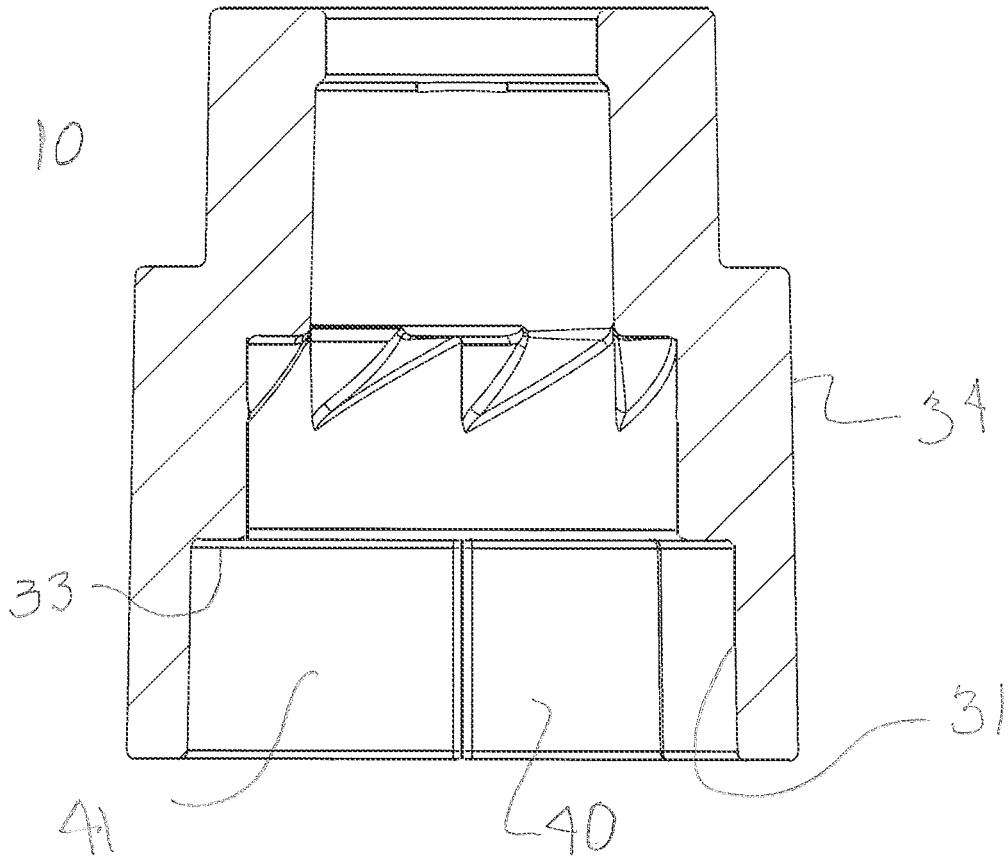
FIG. 10 is a front elevation sectional view of a second embodiment.
Figure 11:
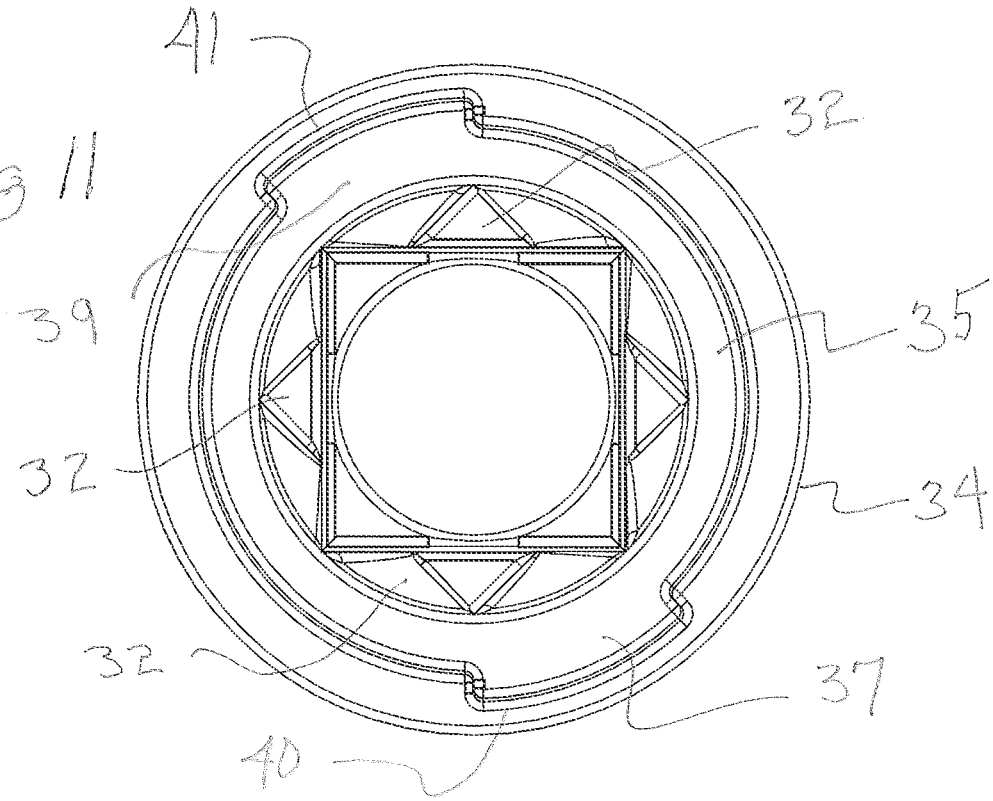
FIG. 11 is a bottom plan view.
Figure 12:
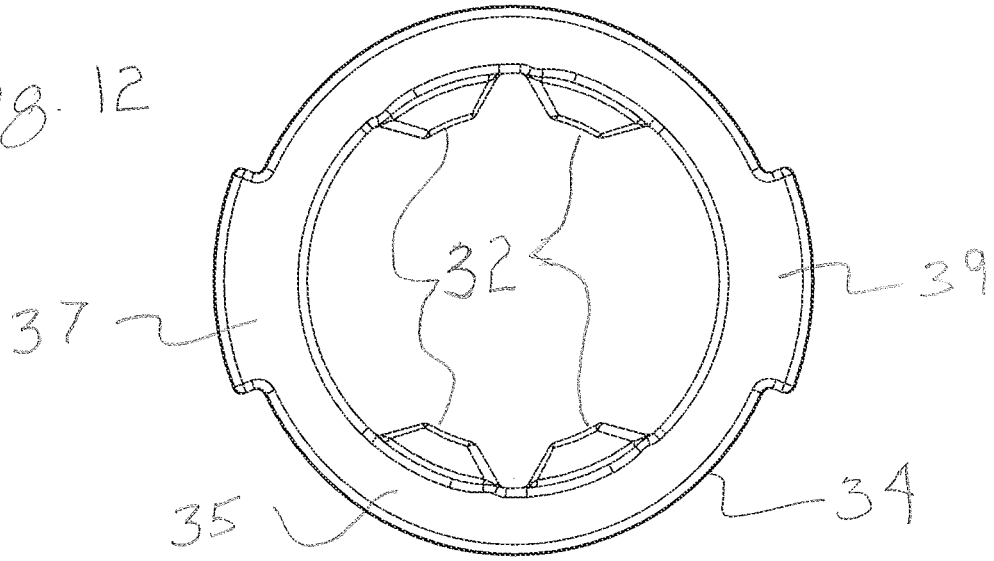
FIG. 12 is a top plan view of the cam ring component of the second embodiment.
Figure 13:
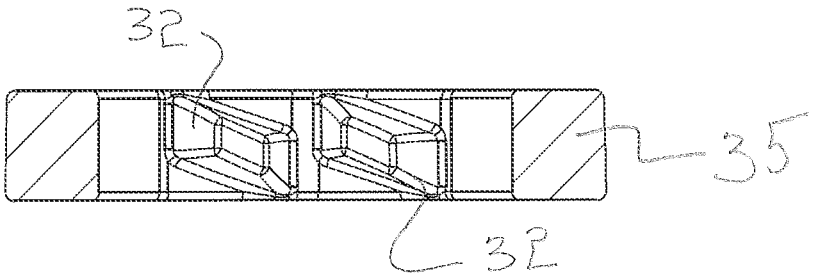
FIG. 13 is a section view taken from FIG. 12 as shown in that figure.
Figure 14:
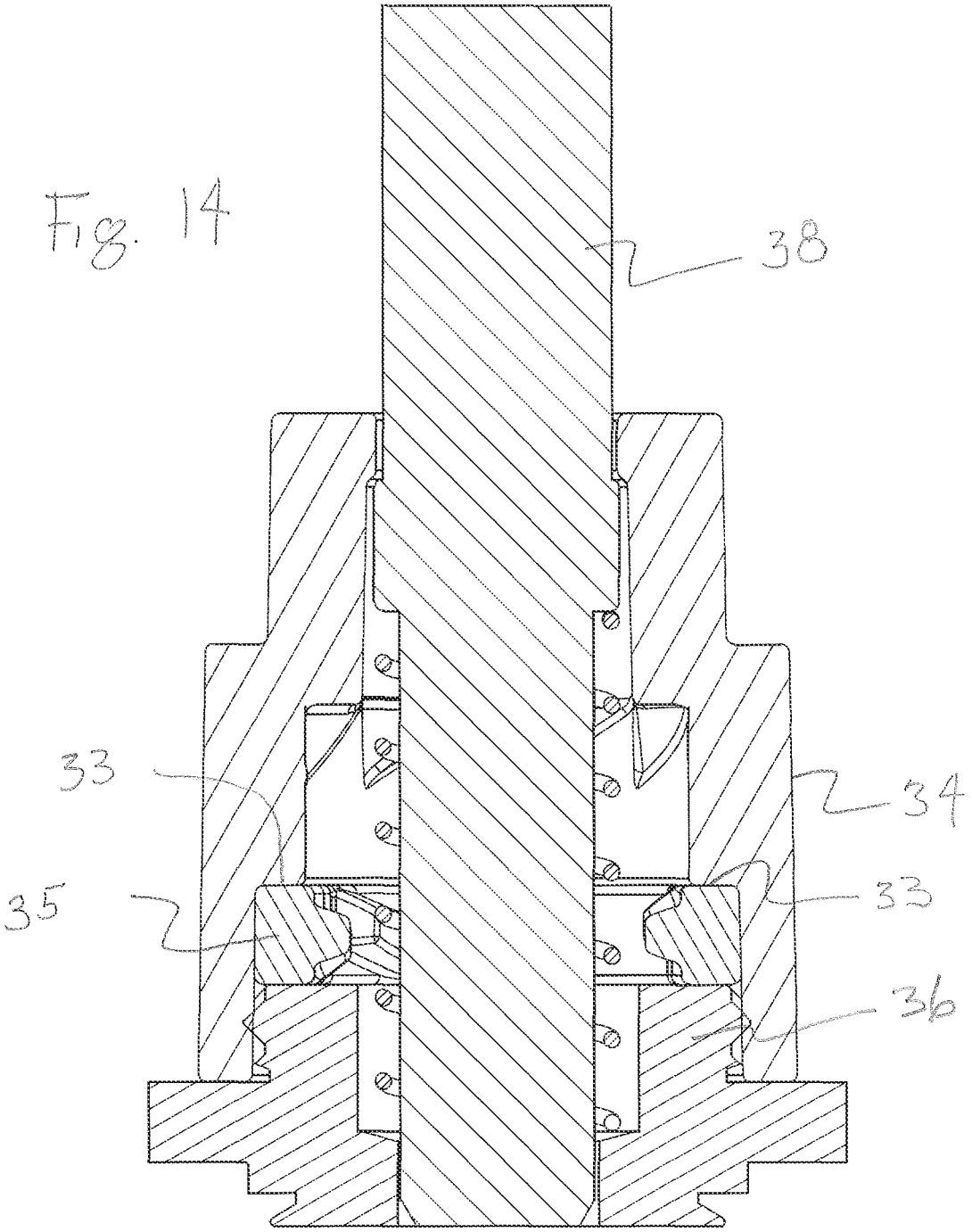
FIG. 14 is an elevation sectional view showing the assembled push button device of the second embodiment.

FIGS. 10 through 14 depict an alternate embodiment of the invention. Referring first to FIG. 14, this second embodiment utilizes a separate cam ring 35 insert for providing the lower set of cams on the floor of the central cavity which in this embodiment is defined by the top surface of the end cap 36. The operation of both embodiments is essentially the same with the plunger assuming the extended and retracted positions within the retainer as seen in FIGS. 8 and 9 of the previous embodiment. The cam ring insert is seen in isolation in FIGS. 12 and 13 and its position within the retainer 34 is shown in FIGS. 11 and 14. The same configuration of the plunger is employed in both embodiments.

In this alternate embodiment the internal configuration is of the retainer is different to accept the admission of the cam ring 35. As seen in FIG. 10, the retainer has an extended counterbore 31 at the bottom to allow introduction of the ring. A collar 33 at the top of the counterbore of the retainer 34 abuts the top face of the ring which is captured between the end cap and the top of the counterbore. The retainer 34 has keyways 40 and 41 as also shown in FIG. 11 that receive matching cam ring keys which project axially from the periphery of the cam ring.

Referring now to FIG. 11 a bottom plan sectional view taken from just beneath the cam ring 35 shows the ring keys 37 and 39 located within the retainer bore keyways 40 and 41 in the retainer bore side wall. The location and shape of the cams provide a square opening to accept the plunger when it is first assembled into the retainer.

Referring now to FIGS. 12 and 13, the cam ring has two radially outward extending keys 37 and 39 and inward projecting cams 32. The cams 32 operate against the plunger in the same way as the previous embodiment which cause the plunger to rotate. The cams however are oriented differently. In this embodiment the cams extend radially inwardly rather than axially as in the previous embodiment. Cams 32 are provided on the top and bottom faces of the ring 35 so that the ring is symmetrical about the midplane. This allows the ring 35 to be inserted into the retainer 34 in either top or bottom orientation to simplify the assembly process. The ring shown has the minimum number of two operational cams on each face but can be configured with a maximum of eight cams.

In FIG. 14 we see the positioning of the cam ring 35 within the retainer 34. During assembly the ring is clamped between the top of the end cap 36 and a collar 33 at the top of the counterbore. The retainer has keyways which accept the keys of the cam ring to ensure the accurate radial orientation of the ring cams as seen in FIG. 11. The top surface of the end cap 36 defines the floor of the central cavity but otherwise has the same attachment features seen in the embodiment depicted in FIGS. 1-9. The other structures of the retainer 34 are the same and operate upon plunger 38 similarly.

The dimensions shown in the embodiments depicted may be varied to suit a particular application as desired. For example, the square portion side lengths and the diameters of the plunger pin can be made in any suitable dimensions required. Also, the distance between the upper and lower boundaries of the central cavity can be easily modified. This distance and length of the plunger pin determines how far the pin will protrude through the bottom of the retainer end cap. The bottom region of the body, which has a counterbore, provides sufficient material for the end cap to broach into the retainer body and captivate the assembly to the retainer as seen in FIGS. 8, 9 and 14. The distal end of the end cap can have any suitable attachment means for affixation to a supporting structure such as a panel with a receiving hole.

While but two embodiments of the invention have been described above, it should be understood that there may be many variations to what has been shown and described that fall within the scope and spirit of the invention. The invention shall be defined only by the following claims and their legal equivalents.

What is claimed is:

1. A push button, comprising:

a retainer with top and bottom ends and an axial bore extending from the top end to the bottom end of the retainer, the retainer further comprising a collar at a distal portion of the top end;

wherein the axial bore includes a central cavity and a counterbore, the counterbore extending from a distal portion of the bottom end, the central cavity bounded by a roof portion and a top of the counterbore, said roof portion having a first set of cams;

a cam ring insert formed as a separate feature from the retainer, disposed against the top of the counterbore, and including a second set of cams;

a plunger received within the axial bore and axially slidable between extended and retracted positions, said plunger comprising:

a button portion at a distal top end of the plunger, a pin portion at a distal bottom end of the plunger, and a flanged midsection of lateral square cross-section located between the top and bottom ends of the plunger, and wherein corners of the flanged midsection act upon the first and second sets of cams when the plunger is moved between the retracted and extended positions whereby the plunger is rotated.

2. The push button of claim 1 constructed such that during a first upward movement of the plunger, the plunger is stopped when the flanged midsection abuts the collar thereby defining a stable retracted position of the plunger within the retainer.

3. The push button of claim 2 constructed such that during a second upward movement of the plunger after the first upward movement the plunger, the plunger is stopped by the roof portion of the central cavity thereby defining a stable extended position of the plunger.

4. The push button of claim 1, further comprising an end cap affixed to the bottom end of the retainer.

5. The push button of claim 4 wherein the end cap is affixed to the retainer by broaching.

6. The push button of claim 1 wherein the extended and retracted positions of the plunger are each alternatively changed from one to the other by a first down stroke of the plunger then a second sequential up stroke of the plunger, said combined up and down strokes defining a plunger cycle.

7. The push button of claim 5 wherein the second set of cams engage the plunger midsection during the first down stroke of the plunger and the first set of cams engage the plunger midsection during the up stroke of the plunger.

8. The push button of claim 7 wherein the first and second sets of cams engage only the corners of the flanged midsection.

9. The push button of claim 6 wherein a change in plunger position to and from retracted and extended positions is performed by pressing and then releasing the button portion of the plunger.

10. The push button of claim 9 wherein each plunger cycle causes the plunger to rotate 45 angular degrees.

11. The push button of claim 6 wherein the first and second sets of cams are oriented to apply a turning force to the plunger in the same rotational direction in both axial up and down directions of each plunger cycle so that the rotary positional advancements of the plunger are additive.

12. The push button of claim 1 wherein the cams of the first set of cams have the same shape and are equally spaced about a 360-degree circular array, and the cams of the second set of cams have the same shape and are equally spaced about a 360-degree circular array.

13. The device of claim 12 wherein the first and second sets of cams are radially offset from each other 22.5 angular degrees.

14. The push button of claim 1, further comprising an end cap configured to attach the push button to an object.

15. The push button of claim 1, further comprising a spring.

16. The push button of claim 15, further comprising an end cap, the spring disposed between the plunger and end cap to urge the plunger upwardly toward the top end of the retainer.

17. The push button of claim 1, wherein the cam ring insert has a periphery including radially outwardly extending keys configured to match corresponding keyways formed into the counterbore.

18. The push button of claim 1, wherein the cams of the second set of cams are located on top and bottom faces of the cam ring insert so that the cam ring insert is symmetrical about a midplane.

19. The push button of claim 1, wherein the cam ring insert is disposed in the retainer between an end cap disposed at the bottom end of the retainer and the collar.

20. The push button of claim 1, wherein the first and second sets of cams are disposed opposite each other such that the first and second sets of cams face each other.

* * * * *